US006259347B1

(12) United States Patent
Sines

(10) Patent No.: US 6,259,347 B1
(45) Date of Patent: Jul. 10, 2001

(54) ELECTRICAL POWER COOLING TECHNIQUE

(75) Inventor: Eddie Sines, Manassas, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 08/940,179

(22) Filed: Sep. 30, 1997

(51) Int. Cl.[7] ..... H01F 27/08; H01F 27/30

(52) U.S. Cl. ..... 336/219; 336/206; 336/61; 336/205

(58) Field of Search ..... 336/69, 70, 55, 336/180, 61, 84, 90, 219, 205, 206

(56) References Cited

U.S. PATENT DOCUMENTS

| | | | | |
|---|---|---|---|---|
| 3,659,239 | | 4/1972 | Marton | 336/57 |
| 3,810,303 | * | 5/1974 | Hoell | 336/207 |
| 4,081,776 | | 3/1978 | Hisamoto et al. | 336/61 |
| 4,082,916 | * | 4/1978 | Jaklic, Jr. et al. | 336/96 |
| 4,195,686 | * | 4/1980 | Pierce | 336/55 |
| 4,308,512 | * | 12/1981 | Capecchiacci et al. | 336/57 |
| 4,496,923 | | 1/1985 | Lenzing | 336/59 |
| 4,956,626 | * | 9/1990 | Hoppe et al. | 336/60 |
| 4,960,967 | * | 10/1990 | Buffenoir et al. | 336/55 |
| 5,077,103 | | 12/1991 | Wagner et al. | 428/34.1 |
| 5,091,666 | * | 2/1992 | Jarczynski | 310/54 |
| 5,158,690 | * | 10/1992 | Batchelder et al. | 210/775 |
| 5,258,888 | * | 11/1993 | Korinsky | 361/704 |
| 5,418,063 | | 5/1995 | Booth | 428/408 |
| 5,471,367 | | 11/1995 | Krumweide et al. | 361/179 |
| 5,542,411 | | 8/1996 | Dickinson | 165/170 |
| 5,542,471 | * | 8/1996 | Dickinson | 165/170 |
| 5,783,877 | * | 7/1998 | Chitayat | 310/12 |

OTHER PUBLICATIONS

Biess, "20KHZ PMAD Technology For Power System Test Bed–Space Station Freedom", NASA Contractor Report 185160, Oct. 1989.

* cited by examiner

*Primary Examiner*—Michael L. Gellner
*Assistant Examiner*—Anh Mai
(74) *Attorney, Agent, or Firm*—Barry A. Edelberg; Charles J. Stockstil

(57) ABSTRACT

The apparatus for cooling a high power electrical transformer and electrical motors uses thermally conductive material interleaved between the turn layers of a high power transformer and iron core laminates to provide a low resistant thermal path to ambient. The strips direct excess heat from within the interior to protrusions outside of the windings (and core) where forced air or thermally conductive potting compound extracts the heat. This technique provides for a significant reduction of weight and volume along with a substantial increase in the power density while operating at a modest elevated temperature above ambient.

21 Claims, 7 Drawing Sheets

10

12
23
22
17

18
16
16
14
16
22
MAGNETIC CORE
BASE PLATE
18
16
25

23
22

ELECTRICAL POWER COOLING TECHNIQUE

BACKGROUND OF THE INVENTION

1. Field of the Invention

This invention pertains generally to electrical power devices and more particularly to an apparatus for cooling electrical power devices.

2. Description of the Related Art

The power rating of present-day electrical devices, such as power transformers and motors, is limited by heat accumulation due to resistive losses in the copper windings and, in the case of power transformers, to losses from eddy currents and hysteresis within the iron or ferrite cores. It is not generally recognized that the magnetic flux within a transformer core remains approximately constant when the power output is increased. It is therefore unnecessary to increase the amount of iron or ferrite core material to increase the size of the transformer core in order to deliver more power. The trapped heat produced by the windings while operating at high power is the major limiting factor for high power transformers.

Different approaches have been attempted to try and remove heat from the core of power transformers. Some of these are the increasing of wire size to reduce resistive losses; immersion of the transformer in circulating coolant oil; air cooling of the transformer windings; increasing the operating frequency of the transformer to reduce windings; and increasing the thermal conductivity of the insulating potting compound around the transformer windings. All of these, however, impact on the mechanical size and weight of the transformer designs limiting the use of these applications. Without proper cooling the efficiency and reliability of these transformers and motors are considerably reduced.

SUMMARY OF THE INVENTION

The object of this invention is to provide an apparatus for cooling high power electrical devices.

Another object of this invention is to provide a cooler operating high power electrical device that is of light weight, low cost, higher power density, and highly efficient design.

These and other objectives are obtained by placing thermal conductive strips between the turn layers along the axis and perpendicular to the turns of an high power electrical device, such as a transformer or motor, which extends outside of the windings or between the laminates of the core. The excess heat is conducted outward from the interior of the device along the strips to the outside of the device's windings where it is extracted from the protrusions by means of a highly thermal-conductive potting compound that has a short thermal path to a small heat sink.

DESCRIPTION OF THE PREFERRED EMBODIMENT

Figures 1A, 1B:
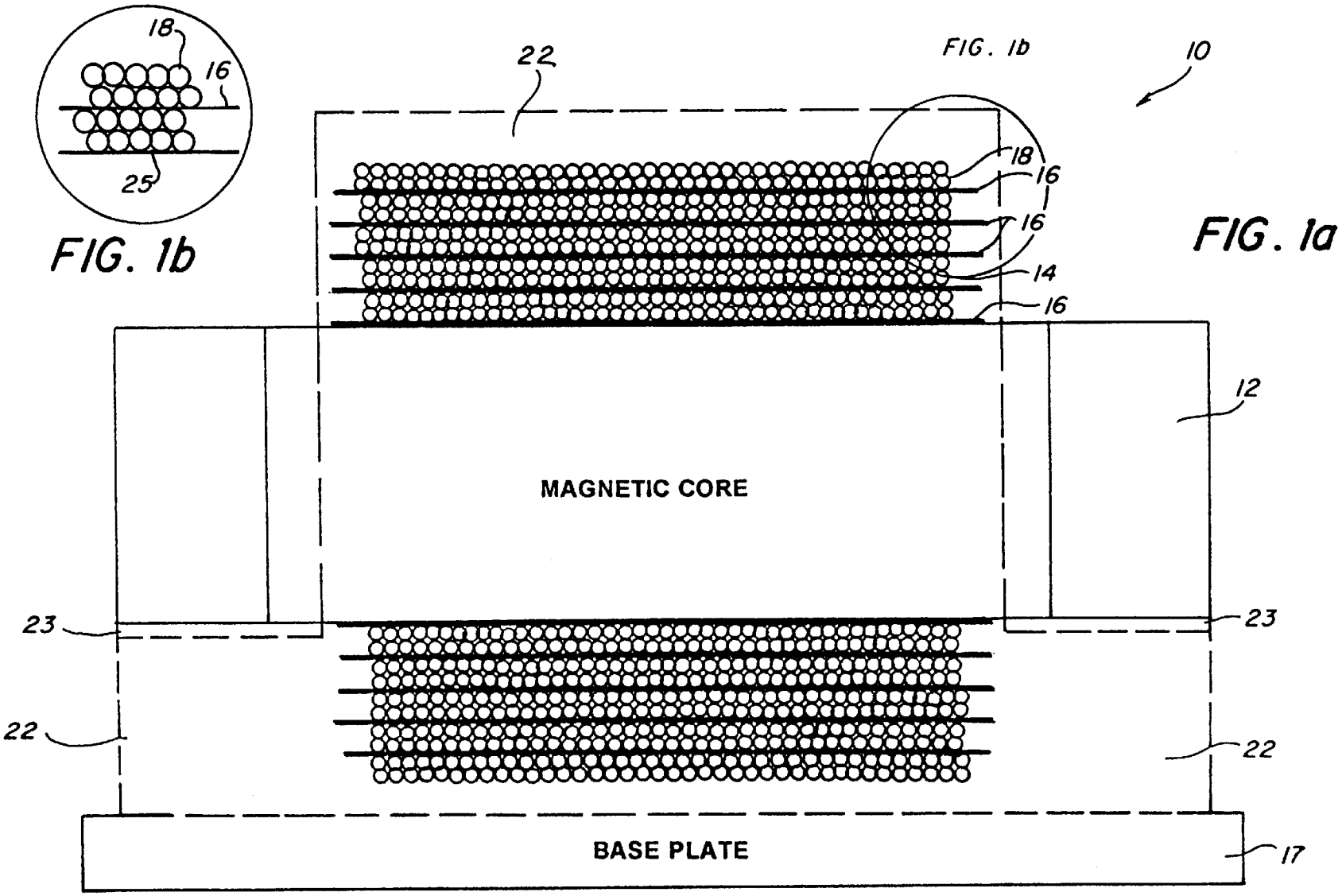
FIG. 1*a* shows a cutaway view of a transformer with a thermal conductive strip between layers of wire turns around the transformer core.
FIG. 1*b* shows the position of a thermal grease.

The apparatus for cooling a high power electrical device, such as a transformer 10, as shown in FIG. 1, comprised of various core materials such as laminated iron, ferrite, and other core materials known to those skilled in the art. The transformer core 12 is comprised of electrical windings of conducting material 14; preferably a flexible, high dielectric electrically copper wire, preferably insulated with KAPTON® type 150FN019, manufactured by DuPont of Wilmington, Del., or similar material, wrapped around the transformer core 12. KAPTON® type FN is a type HN film coated on one or both sides with TEFLON® FEP fluorocarbon resin to impart heat sealability, to provide a moisture barrier and to enhance chemical resistance. The KAPTON® prevents electrical shorts between conductors and adjacent layers. Heat is dissipated from the transformer core 12 to ambient through a base plate 17.

A thermally conductive material, or strip, 16 placed in preselected locations between the windings of electrically conductive material 14, the ends of which protrude outside of the area covered by the conductive material 14. In the example shown in FIG. 1 of a completed transformer 10, the thermally conductive material 16 is inserted between every other layer of electrically conductive material 14. The thermally conductive strip 16, is preferably a high modulus carbon graphite laminate material, such as an Amoco type K1100X pitch fiber processed by Composite Optics of San Diego, Calif. The laminate of the conductive strip 16 is an anisotropec material that is highly efficient in conducting heat along the fiber orientation which is unidirectional. An alternative material for the thermally conductive strip 16 is copper or a ceramic, however these have not been found to be as efficient in conducting heat away from the center of a device, such as the transformer 10, as the high modulus carbon graphite laminate material.

The thermally conductive strip 16 normally has a smooth epoxy surface finish. To improve the thermal interface by as much as 10%, the strips 16 must be lightly scraped with a sharp instrument, such as a razor blade, to remove a small portion of the residual epoxy and fibers left over from the manufacturing process. After scraping, the strip 16 will appear dull with a graphite appearance.

Because the thermally conductive strip 16 normally will have sharp edges on the sides, a narrow glass tape (not shown), approximately 0.005 inches thick, 0.250 inches wide, and having a voltage breakdown of approximately 5 kV, such as 3M glass cloth tape No. 361, a pressure sensitive, 7.5 mil tape good to a temperature of 235° C., manufactured by 3M Electrical Products Division of Austin, Tex., is used to buffer the layers of the windings 14 from the thermally conductive strip 16 to prevent damage to the winding 14 coating thereby shorting out the transformer.

The glass tape (not shown) is placed on the edge of the thermally conductive strip 16 on both sides of the strip 16 and offset by one-half the tape width parallel to the strips 16. In the art this technique is commonly referred to as "butterflying." The application of the glass tape (not shown) forms a wedge adjacent to the edge of the strip 16.

A thermally conductive grease 25, as shown in FIG. 1*a* in a typical location such as type 120-8, manufactured by Wakefield of Wakefield, Mass., is placed in the wedge formed by the tape (not shown) and the strip 16; a technique well known to those skilled in the art. The strip 16 is installed into the core 12 on top of the thermal grease 25 and a second application of the thermal grease 25 (not shown) is used to cover the strip 16. The thermal grease 25 is placed between the two layers of glass tape (not shown) and a second piece of glass tape (not shown) is placed over the first by starting at one edge and lowering the tape (not shown) to the strip 16. A light pressure is used to encompass the two glass tapes (not shown) together and make contact with the strip 16 sealing the thermal grease 25 inside of the structure. This is accomplished on both sides of the strip 16, as previously stated. Heat generated within the transformer by resistive losses in the windings of electrically conductive material 14 when an electrical current is applied to the transformer and due to eddy currents within the core 12 is conducted to the portions of the thermally conductive strip 16 protruding outside of electrical the windings of conductive material 14 and in contact with the ferrite core or iron laminates 12.

Surrounding the transformer 10 is a high thermal-conductivity potting compound 22, such as STYCAST® 2850, or similar material. STYCAST® 2850 is a highly filled, castable epoxy system manufactured by Emerson & Cumming, Inc. of Lexington, Mass. Potting of the transformer core 12 is accomplished by placing the completed wound copper-core in a mold (not shown) in which potting compound 22 is molded around the transformer core 12 to provide a short thermal path to a base-plate main heat sink 17 where excess heat is dissipated to surround atmosphere. The mold (not shown) with the transformer 10 and potting compound 22 is placed into an evacuated chamber (not shown) until the potting compound 22 expands to the top of the mold (not shown) and cured for approximately two hours at approximately 100 degrees centigrade. The vacuum atmosphere within the chamber (not shown) further forces the thermally conductive epoxy (not shown) in and around the windings 14 of the completed copper core and the mold profile, thereby, further enhancing the heat dissipation of the strips 16. The vacuum is applied and released a number of times until the potting compound 22 stops expanding to insure that very little air remains within the windings 14 or mold assembly (not shown). This will eliminate core failures due to corona. Additional potting compound 22 may have to be added to the mold (not shown) so as to cover completely the windings 14 when done.

The potting compound 22 on a transformer 10 is extended to the outer edge of the transformer core 12 on the base plate side only. On the other side the potting compound 22 need extend only past the outer edges of the thermally conductive strip 16.

To prevent mechanical stresses on the transformer core 12 due to the expansion of the potting compound 22, the mold assembly should be designed so as to provide a "head space" or gap 23 between the potting compound 22 and the transformer core 12. In assembly this space is filled with a thermal heat sink strip , such as SIL-PAD® 2000, manufactured by Berquist of Minneapolis, Minn.

Alternatively, in place of the potting compound 22, the heat may be conducted from the ends of the thermally conductive strips 16 by the use of a fan (not shown), a technique that is well known to those skilled in the art.

Figure 2:
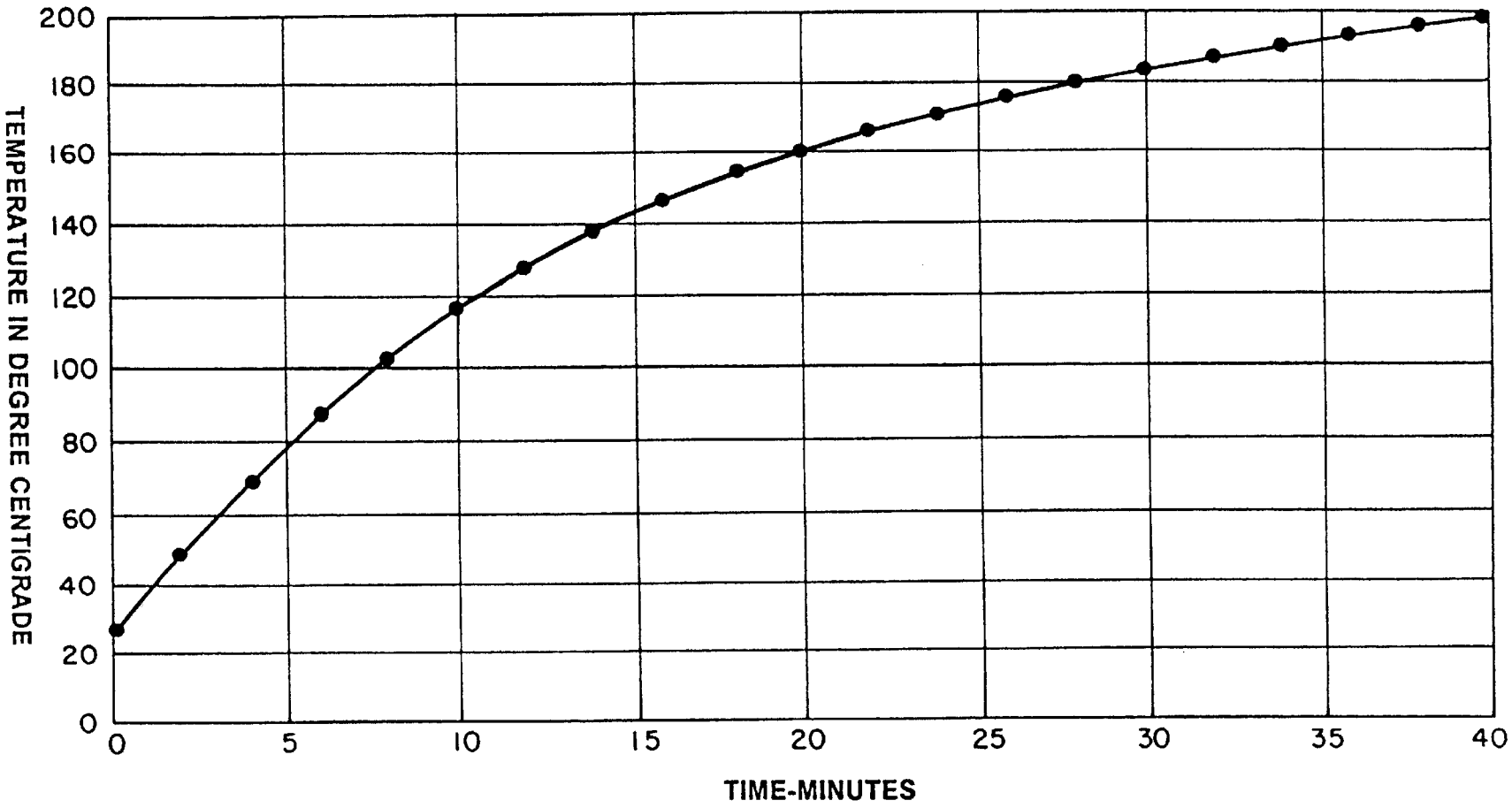
FIG. 2 shows the temperature gradient for a transformer constructed utilizing current state-of-the-art techniques.

In a design of a test transformer, a 2 kva (2 kW) power transformer providing 1.2 lb/kW was constructed using modern state-of-the-art techniques well known to those skilled in the art. The design measures 3.02 inches by 3.17 inches by 2.22 inches, and weighed 2.4 pounds. In tests, the transformer constructed according to state-of-the-art techniques, after 40 minutes, showed a windings temperature of 200° C. at the center of the windings and suffered catastrophic failure due to excess heat (FIG. 2).

Figure 3:
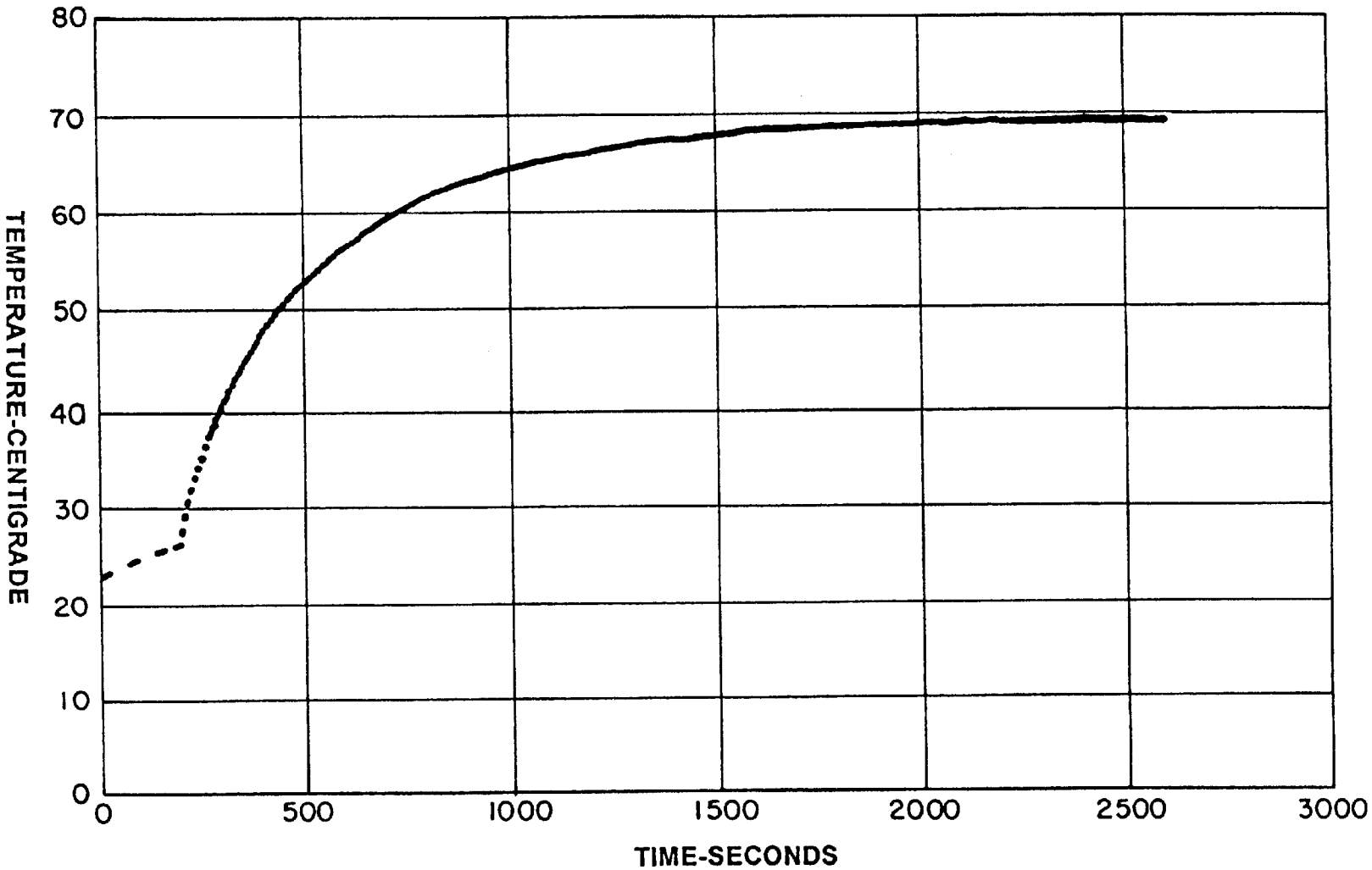
FIG. 3 shows the temperature gradient for a transformer constructed utilizing a thermal conductive strip technique.

A duplicate transformer 10 weighing approximately 0.21 lb/kW was constructed utilizing the technology set forth in this invention with the K1100 conductive strips 16 placed within the windings 14 of the transformer. The design measured 3.02 inches by 3.17 inches by 2.22 inches and weighed 2.4 pounds. In tests, the transformer 10 with the thermally conductive strips 16 placed alternately between windings (FIG. 1) showed, after approximately 40 minutes, a windings 14 temperature of approximately 70° C. without failure (FIG. 3).

This invention allows for the reduction in size of a high power transformers by a factor of 4 to 8 and a reduction in weight by a factor of 4 to 6, and an increase in power density by 5 to 10 in power. The efficiency of the transformer is improved by maximizing the heat transfer from the transformers interior and minimizing voltage breakdown. The thermal properties of each core 12 will dictate the quantity of the thermally conductive strip 16 material required to lower the transformer temperature to a predetermined level, some testing may be required to established the optimal amount needed to provide proper cooling.

Figure 4A:
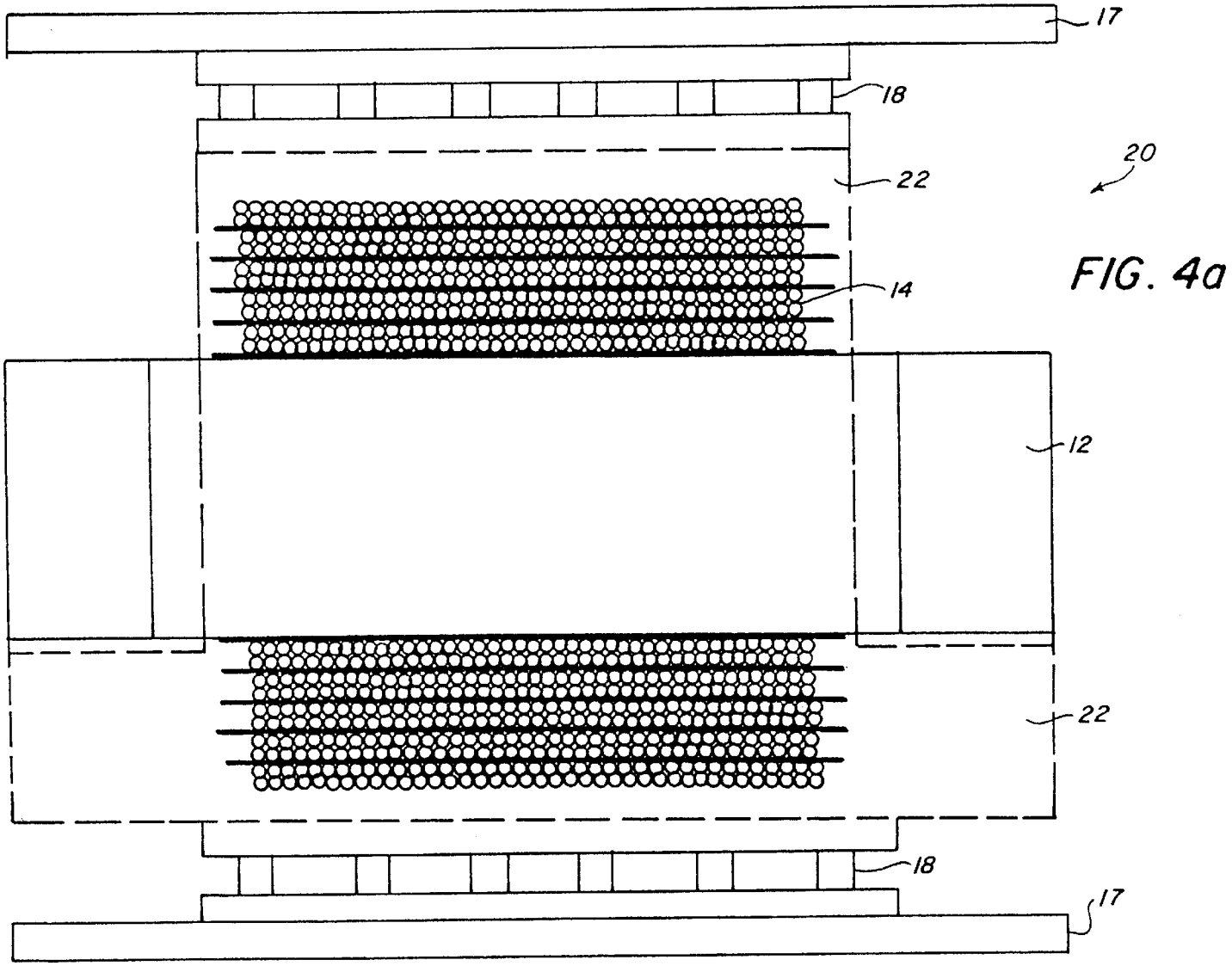
FIG. 4*a* shows a cutaway view of a transformer with a thermal conductive strip between layers of wire turns around the transformer core and a thermocooler.
Figure 4B:
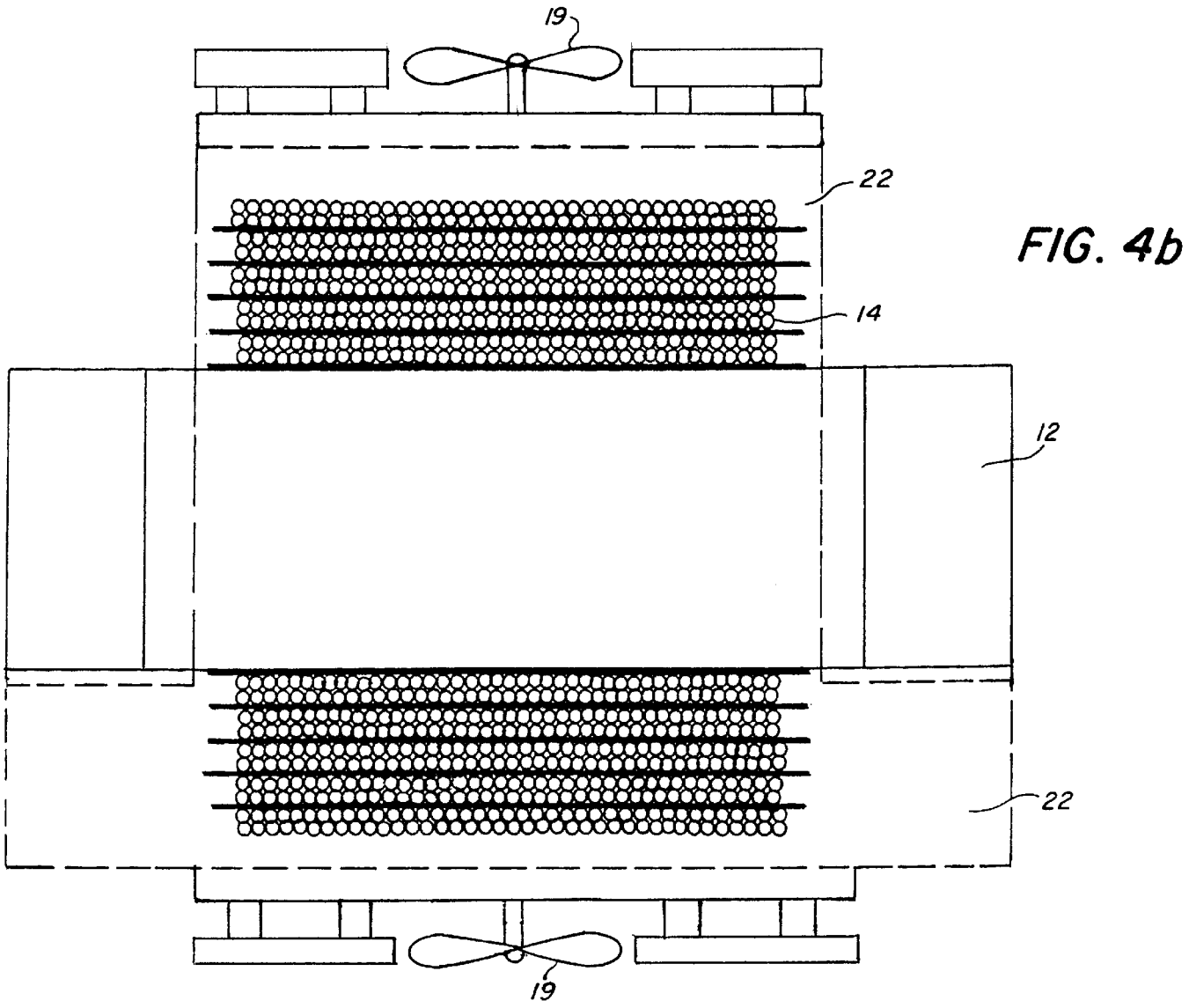
FIG. 4*b* shows a cutaway view of a transformer with a thermally conductive strip between layers of wire turns around the transformer core and a fan.
Figure 4C:
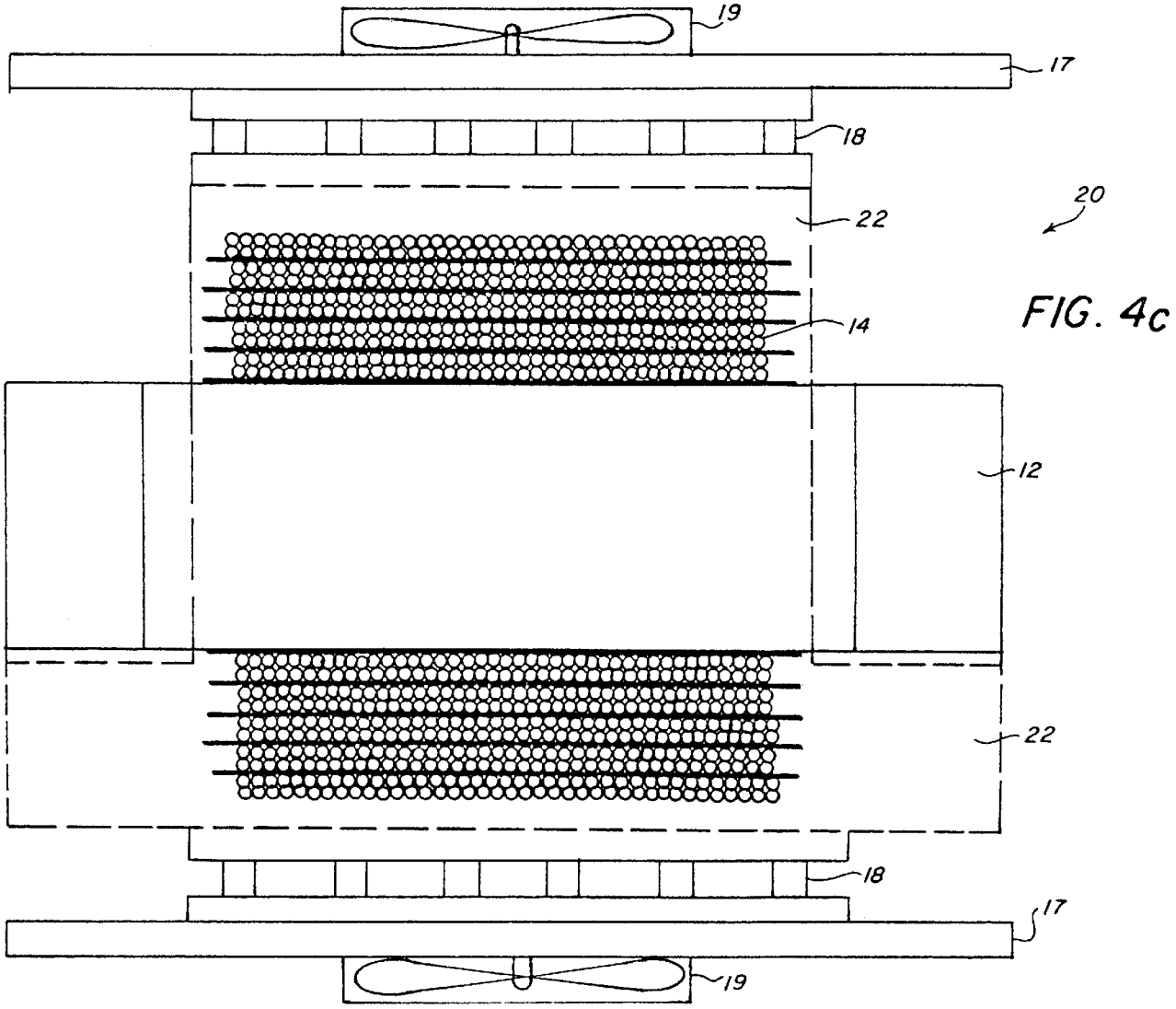
FIG. 4*c* shows a cutaway view of a transformer with a thermally conductive strip between layers of wire turns around the transformer core and a thermocooler with a fan.

When additional cooling is required or to raise the power of a transformer 20, a thermocooler 18, as shown in FIG. 4*a* such as a Model CP2-127-06-7 made by Melcon of Trenton, N.J., a fan 19, as shown in FIG. 4*b*, or a combination of a thermeralcooler 18 and a fan 19, as shown in FIG. 4*c*, may applied to the outside of the transformer 20. The thermocooler 18, with or without a cooling fan (not shown). Control of the thermocooler 18 may be such that it could be turned on and off as cooling demands raise and lower. The thermocooler 18 may be attached to the outer portions of the transformer 20 where it could be easily removed for replacement, if required. In some instances it may be desirable to selective control the operation of the thermocooler 18, therefore a control device such as a timer (not shown) or thermal switch (not shown) may be integrated into the transformer 20 package to either increase the thermal conductivity or decrease it by switching the thermocooler on or off, as desired.

Although this embodiment has been described in relation to an exemplary device such as a transformer, the claimed invention may equally well be utilized in other types of electrical devices where internal heat is a problem, such as motors, modulation transformers, etc. The size of the transformer is not of concern, it may vary from a small transformer used in switching power supplies to power transformers used in electrical distribution systems. Further, the frequency of the electrical current within the devices to be cooled is irrelevant, e.g., 60 cycles to 400 cycles operate the same thermally. High frequency transformers have higher copper losses due to skin effects. This additional heat may also be removed by the thermally conductive strip as set forth in this invention.

Figure 5A:
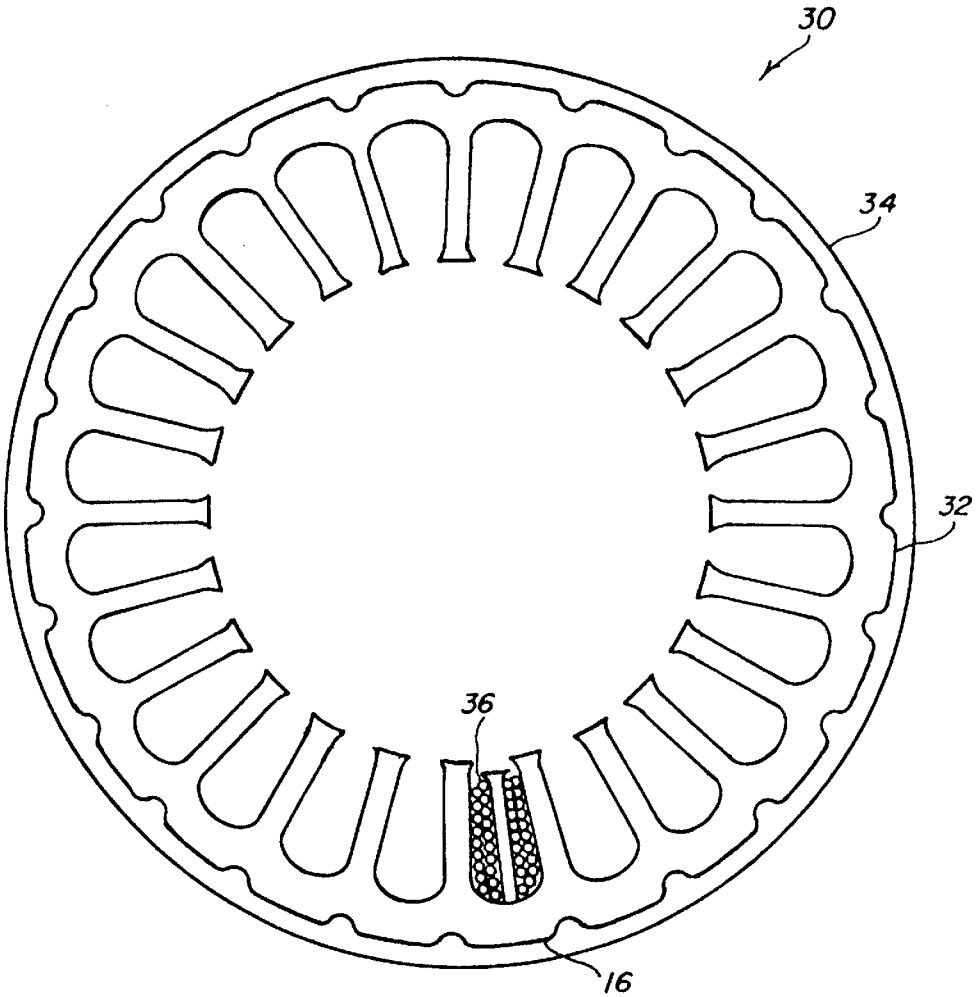
FIG. 5*a* shows an electric motor with a thermal conductive is strip between windings of the motor.
Figure 5B:
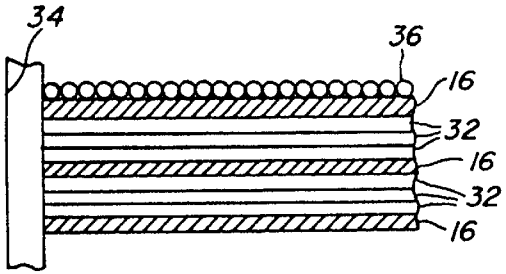
FIG. 5*b* shows a cutaway of a motors laminations with thermal conductive strips interleaved between laminations.

When applied to electrical motors 30, as shown in FIG. 5*a*, pieces of thermally conductive strip 16 are placed between windings of the motor 30 or interleaved into vertically stacked motor laminations 32, as shown in FIG. 5*b*. The internal heat from the motor laminations 32 and windings 36 is conducted from the interior of the motor 30 to the outer portions where the heat is then dissipated through the motor case 34 to ambient atmosphere.

Although the invention has been described in relation to the exemplary embodiment thereof, it will be understood by those skilled in the art that still other variations and modifications can be affected in the preferred embodiment without detracting from the scope and spirit of the invention as stated in the claims.

What is claimed is:

1. An electrical device comprised of one or more layers of electrically conductive material and a core wherein heat is generated by an electrical current and field flowing in the electrically conductive material and core, said device comprising:

one or more thermally conductive strips, a first portion of said thermally conductive strips is placed between layers of the electrically conductive material and in physical contact with the electrically conductive material receiving heat from the electrically conductive material and core, and conducting heat generated within the electrically conductive material and core to a second portion of the thermally conducive material not in physical contact with the electrically conductive material; and means for removing heat from the thermally conductive strips.

2. An electrical device, as in claim 1, wherein the thermally conductive strip is a high modulus carbon graphite laminate material.

3. An electrical device, as in claim 1, wherein the thermally conductive strip is copper.

4. An electrical device, as in claim 1, wherein the thermally conductive strip is a ceramic.

5. An electrical device, as in claim 1, wherein the means for removing heat from the conductive strip is a thermally conducting potting compound.

6. An electrical device, as in claim 1, wherein the means for removing heat from the conductive strip is a fan.

7. An electrical device, as in claim 1, wherein the thermally conductive strip is a carbon-like material.

8. An electrical device, as in claim 1, wherein the electrical device is composed of layers of electrically conductive material.

9. An electrical device, as in claim 1, wherein the conducting strip is anisotropic.

10. A power transformer comprised of layers of electrically conductive material wrapped around a core wherein heat is generated by an electrical current and field flowing in the electrically conductive material and core, said device comprising:

one or more thermally conductive strips placed between preselected layers of the electrically conductive material, a first portion of the thermally conductive strips in physical contact with the electrically conductive material and a second portion of the thermally conductive strips not in physical contact with the electrically conducive material, said first portion of the thermally conductive strips conducting heat from the electrically conducting material to the second portion of the thermally conductive strips;

said transformer having an upper and lower outer surface;

a thermocooler attached to an outer surface of said transformer for dissipating heat to ambient atmosphere;

means for conducting heat from the second portion of the thermally conductive strips to the thermocooler; and means for controlling an operational cycle of the thermocooler.

11. An electrical device, as in claim 10, further comprising a fan attached to the thermocooler.

12. A power transformer comprised of layers of electrically conductive material wrapped around a core wherein heat is generated by an electrical current and field flowing in the electrically conductive material and core, said device comprising:

one or more thermally conductive strips of high modulus carbon graphite laminate material placed between preselected layers of the electrically conductive material, a first portion of which is in physical contact with the electrically conductive material and a second portion of the high modulus carbon graphite laminate material not in physical contact with the electrically conductive material, said first portion of the high modulus carbon graphite laminate material conducting heat to the second portion of the high modulus carbon graphite laminate material;

said core having a plurality of laminations of core material;

one or more thermally conductive strips of high modulus carbon graphite laminate material placed between preselected laminations of the core and in physical contact with the laminations of the core and a second portion of the thermally conductive material not in physical contact with the electrically conductive material, of the thermally conductive strip conducting heat generated within the laminations of the core to the second portion of the thermally conductive strips; and a highly filled, castable epoxy thermally conductive compound surrounding said transformer for conducting the heat from the second portion of the thermally conductive strips to ambient atmosphere.

13. A power transformer comprised of one or more layers of electrically conductive material wrapped in layers around a core wherein heat is generated by an electrical current and field flowing in the electrically conductive material and core, said device comprising:

one or more thermally conductive strips placed between preselected layers of the electrically conductive material perpendicular to the direction of the electrically conductive material being wrapped around the core, a first portion of the thermally conductive strips are in physical contact with the electrically conductive material and a second portion of the thermally conductive strips is not in physical contact with the electrically conductive material, said thermally conductive strips conducting heat to the second portion of the thermally conductive strips; and means for conducting heat from the thermally conductive strips to ambient atmosphere.

14. A transformer, as in claim 13 wherein the electrically conductive material is copper wire coated with a fluorocarbon resin.

15. A power transformer comprised of one or more layers of electrically conductive material wrapped around a core wherein heat is generated by an electrical current and field flowing in the electrically conductive material and core said device comprising:

one or more thermally conductive strips placed between preselected layers of the electrically conductive material perpendicular to the turns;

a first portion of the thermally conductive strips in physical contact with the electrically conductive material and a second potion of the thermally conductive strips forming a first and second end of the thermally conductive strips not in physical contact with the electrically conductive material, said thermally conductive strip in physical contact with the electrically conducting material conducting heat from the electrically conductive material to the first and second ends of the second portion of the thermally conductive strips;

said core having a plurality of laminations of core material;

one or more thermally conductive strips placed between preselected laminations of the core, a first portion of the thermally conductive strips in physical contact with the laminations of core material, and a second portion of the thermally conductive strips forming by a first and second end of said thermally conductive strips not in physical contact with the laminations of the core, said first portion of the thermal conductive strips conducting heat from the laminations of the core the second portion of the thermally conductive strips; and means for conducting heat from the second portion of the thermally conductive strips to ambient atmosphere.

16. An electrical device generating thermal energy having layers of electrically conductive material comprising:

one or more thermally conductive strips placed between preselected layers of the electrically conductive material, a first portion of the thermally conductive strips in physical contact with the layers of electrically conductive material and a second portion of thermally conductive material not in physical contact with the electrically conductive material, said first portion of the thermally conductive strip conducting thermal energy to of the second portion of the thermally conductive strip; and means for removing thermal energy from the second portion of the thermally conductive material.

17. An electrical device, as in claim 16, wherein the means for removing thermal energy is a base-plate attached to the electrical device.

18. An electrical device, as in claim 16, wherein the means for removing thermal energy is a thermocooler attached to the electrical device.

19. A electrical device, as in claim 16, further comprising a layer of thermal grease between windings of the electrically conductive material and between the electrically conductive material and the first portion of the thermally conductive strips to facilitate the conduction of thermal energy from the electrically conductive material of the second portion of the thermally conductive strips.

20. An electrical device, as in claim 16, further comprising a layer of thermal grease between the core of the electrical device and the means for removing heat to conduct thermal energy.

21. An electrical device, as in claim 16, wherein the electrically conductive material is a flexible, high dielectric electrically insulated wire with a fluorocarbon resin coating.

* * * * *